US012552580B2

(12) United States Patent
Zhang et al.

(10) Patent No.: US 12,552,580 B2
(45) Date of Patent: Feb. 17, 2026

(54) CONTAINER BOTTLE

(71) Applicant: GUANGZHOU TECH-LONG PACKAGING MACHINERY CO., LTD, Guangzhou (CN)

(72) Inventors: Songming Zhang, Guangzhou (CN); Daqun Zou, Guangzhou (CN); Xiaolin Huang, Guangzhou (CN)

(73) Assignee: GUANGZHOU TECH-LONG PACKAGING MACHINERY CO., LTD, Guangdong (CN)

( * ) Notice: Subject to any disclaimer, the term of this patent is extended or adjusted under 35 U.S.C. 154(b) by 109 days.

(21) Appl. No.: 18/549,019

(22) PCT Filed: Apr. 19, 2021

(86) PCT No.: PCT/CN2021/088067
§ 371 (c)(1),
(2) Date: Sep. 5, 2023

(87) PCT Pub. No.: WO2022/183576
PCT Pub. Date: Sep. 9, 2022

(65) Prior Publication Data

US 2024/0150076 A1 May 9, 2024

(30) Foreign Application Priority Data

Mar. 5, 2021 (CN) ..... 202110244754.1

(51) Int. Cl.
*B65D 23/10* (2006.01)
*B65D 1/02* (2006.01)
(Continued)

(52) U.S. Cl.
CPC ..... *B65D 23/10* (2013.01); *B65D 1/0223* (2013.01); *B65D 1/46* (2013.01); *B65D 23/003* (2013.01);
(Continued)

(58) Field of Classification Search
CPC ..... B65D 1/023; B65D 23/10; B65D 1/0223; B65D 1/46; B65D 23/003;
(Continued)

(56) References Cited

U.S. PATENT DOCUMENTS 4,280,630 A * 7/1981 Hafele ..... B65D 23/10 425/525
6,102,458 A * 8/2000 Scace ..... B44D 3/14 220/759
(Continued)

FOREIGN PATENT DOCUMENTS

CA 2567706 C 1/2013
CN 1847097 10/2006
(Continued)

OTHER PUBLICATIONS

International Applicaton No. PCT/CN2021/088067 International Search Report mailed Sep. 28, 2021. 4 pages.
Search Report for related EP21928657.2 mailed Feb. 10, 2025.

*Primary Examiner* — Kareen K Thomas
(74) *Attorney, Agent, or Firm* — Woodard, Emhardt, Henry, Reeves & Wagner, LLP

(57) ABSTRACT

A container bottle includes a bottle body and a handle disposed at the neck of the bottle body, where one end of the handle is connected to the neck of the bottle body, and the other end of the handle is in a free state.

4 Claims, 3 Drawing Sheets

(51) Int. Cl.
*B65D 1/46* (2006.01)
*B65D 23/00* (2006.01)

(52) U.S. Cl.
CPC ..... *B65D 2501/0027* (2013.01); *B65D 2501/0036* (2013.01)

(58) Field of Classification Search
CPC .... B65D 2501/0027; B65D 2501/0036; B65D 1/42; B65D 23/102; B65D 1/40
See application file for complete search history.

(56) References Cited

U.S. PATENT DOCUMENTS

| | | | | |
|---|---|---|---|---|
| 6,896,943 | B1 * | 5/2005 | Beale | B29C 49/071 428/36.9 |
| D900,613 | S | 11/2020 | Sohel et al. | |
| 11,304,549 | B2 * | 4/2022 | Cheng | A47G 19/2205 |
| 2005/0211662 | A1 * | 9/2005 | Eaton | B65D 1/0276 215/373 |
| 2007/0221608 | A1 * | 9/2007 | Axe | B65D 25/2817 215/396 |
| 2007/0272651 | A1 * | 11/2007 | DiPasquale | B65D 23/104 215/396 |
| 2008/0023434 | A1 * | 1/2008 | Takayama | B65D 23/106 215/396 |
| 2008/0110849 | A1 * | 5/2008 | Wachsberg | B65D 47/32 215/323 |
| 2009/0188885 | A1 * | 7/2009 | Nichols | B65D 47/088 29/428 |
| 2012/0193320 | A1 * | 8/2012 | Stanca | B65D 1/0292 141/2 |
| 2013/0327738 | A1 * | 12/2013 | Harrison | B65D 15/14 215/44 |
| 2014/0110369 | A1 * | 4/2014 | Laib | B65D 1/023 215/396 |
| 2015/0102004 | A1 * | 4/2015 | Kelly | B65D 1/0223 220/675 |

FOREIGN PATENT DOCUMENTS

| | | | |
|---|---|---|---|
| CN | 201089556 | Y | 7/2008 |
| CN | 201370371 | Y | 12/2009 |
| CN | 108860948 | A | 11/2018 |
| CN | 208086359 | U | 11/2018 |
| CN | 215437447 | | 1/2022 |
| FR | 2448484 | | 9/1980 |
| JP | H07251843 | | 10/1995 |
| JP | 2009269612 | | 11/2009 |
| KR | 200346134 | | 3/2004 |
| KR | 20070091770 | | 9/2007 |
| KR | 20090009477 | | 9/2009 |
| KR | 20100137281 | | 12/2010 |
| KR | 20150066304 | | 6/2015 |

* cited by examiner

CONTAINER BOTTLE

CROSS-REFERENCE TO RELATED APPLICATION

This is a National stage application, filed under 37 U.S.C. 371, of International Patent Application NO. PCT/CN2021/088067, filed on Apr. 19, 2021, which is based on and claims priority to Chinese Patent Disclosure No. 202110244754.1 filed Mar. 5, 2021, the disclosure of which is incorporated herein by reference in its entirety.

TECHNICAL FIELD

The present disclosure relates to a container bottle, for example, a container bottle with an open handle.

BACKGROUND

Container bottles are commonly used for storing liquids. Currently, handles of small and medium-sized container bottles with a capacity of 3.8 L or below are generally closed. However, the container bottles with closed handles are inconvenient for users to hang and therefore are inconvenient to use.

SUMMARY

The present disclosure provides a container bottle convenient to hang, thereby improving the convenience of use of the container bottle.

A container bottle according to the present disclosure includes a bottle body and a handle disposed at the neck of the bottle body, where one end of the handle is connected to the neck of the bottle body, and the other end of the handle is in a free state.

DETAILED DESCRIPTION

Figure 1:
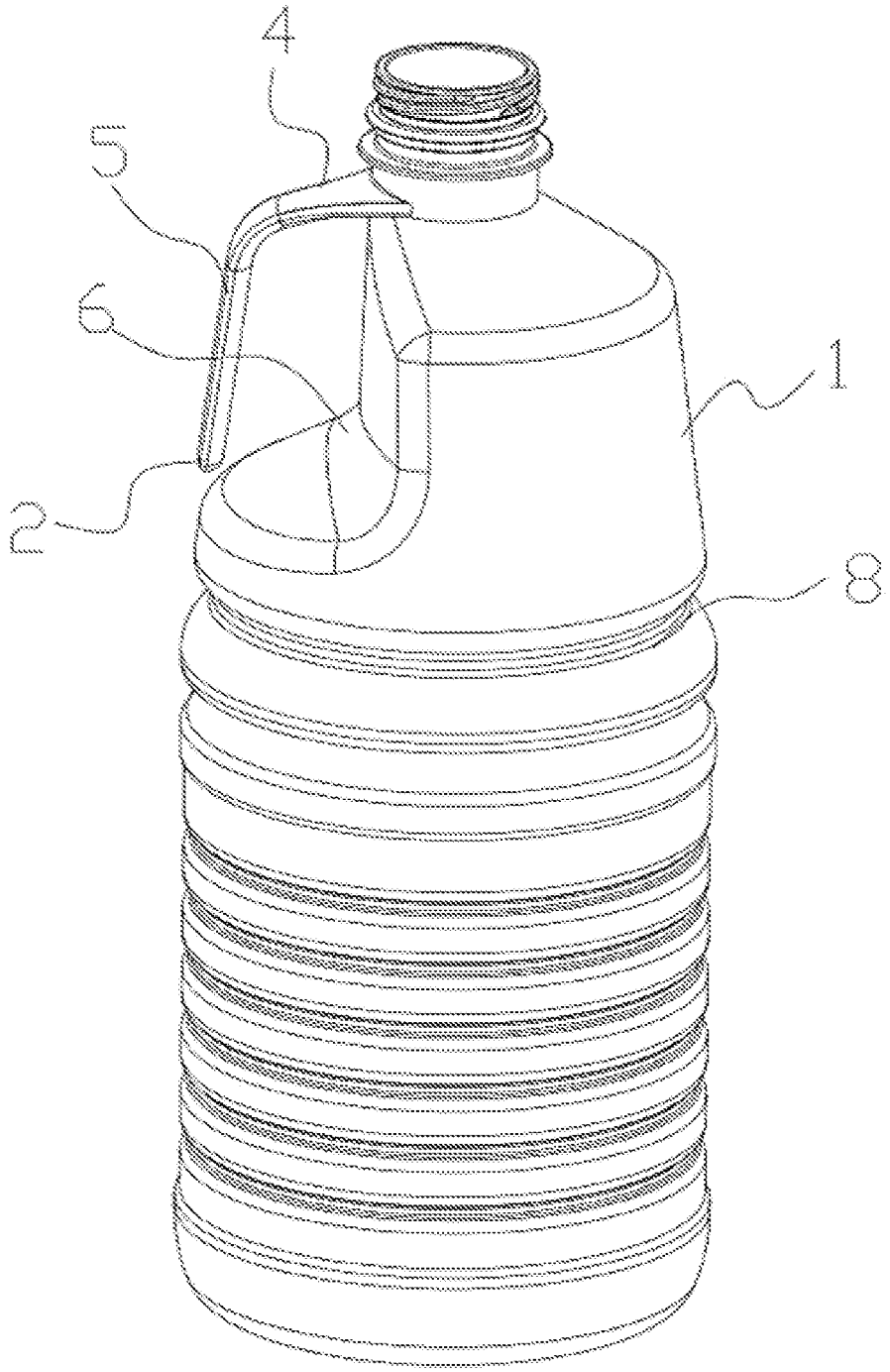
FIGS. 1 to 3 are all structure views of the present disclosure.
Figure 2:
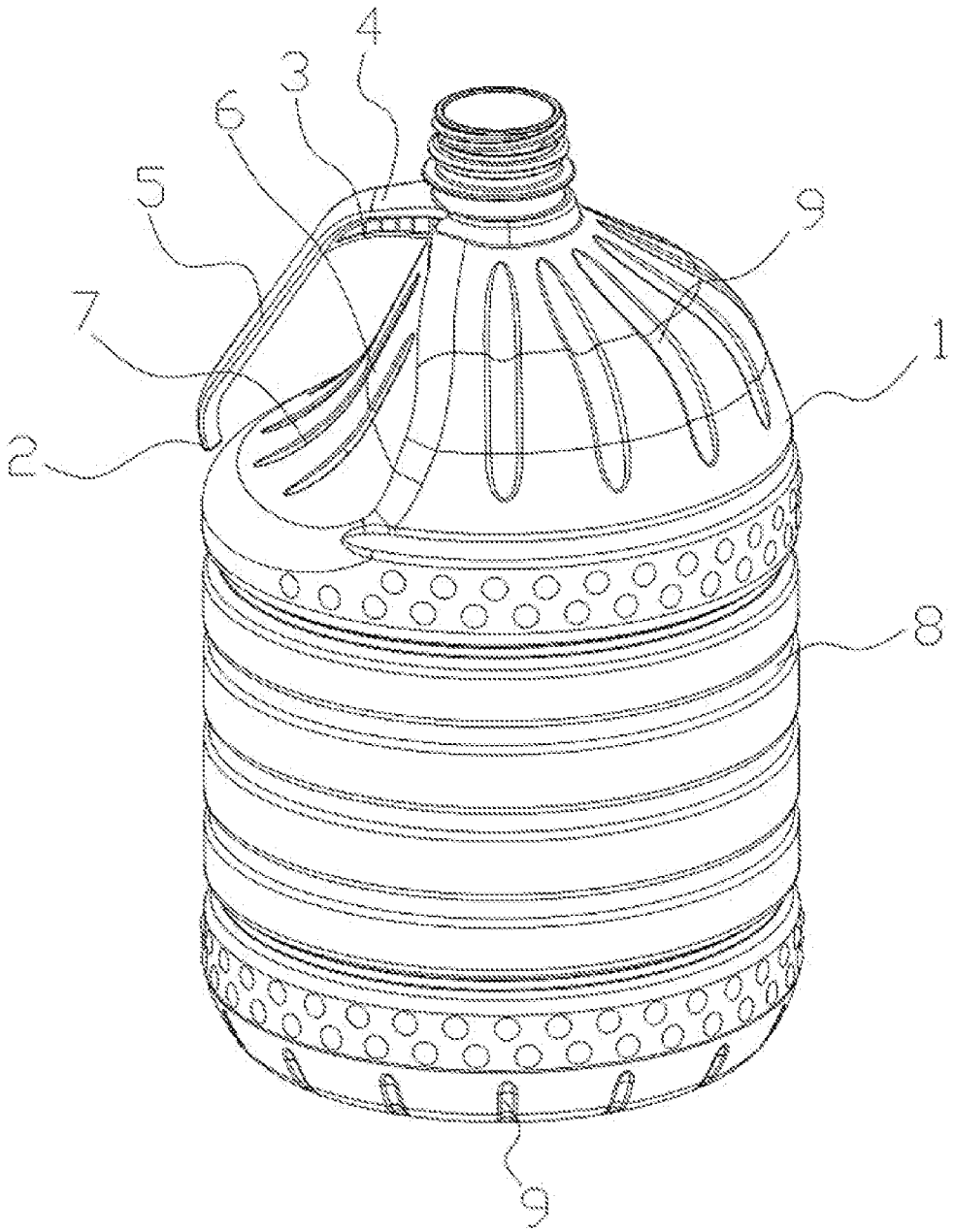
Figure 3:
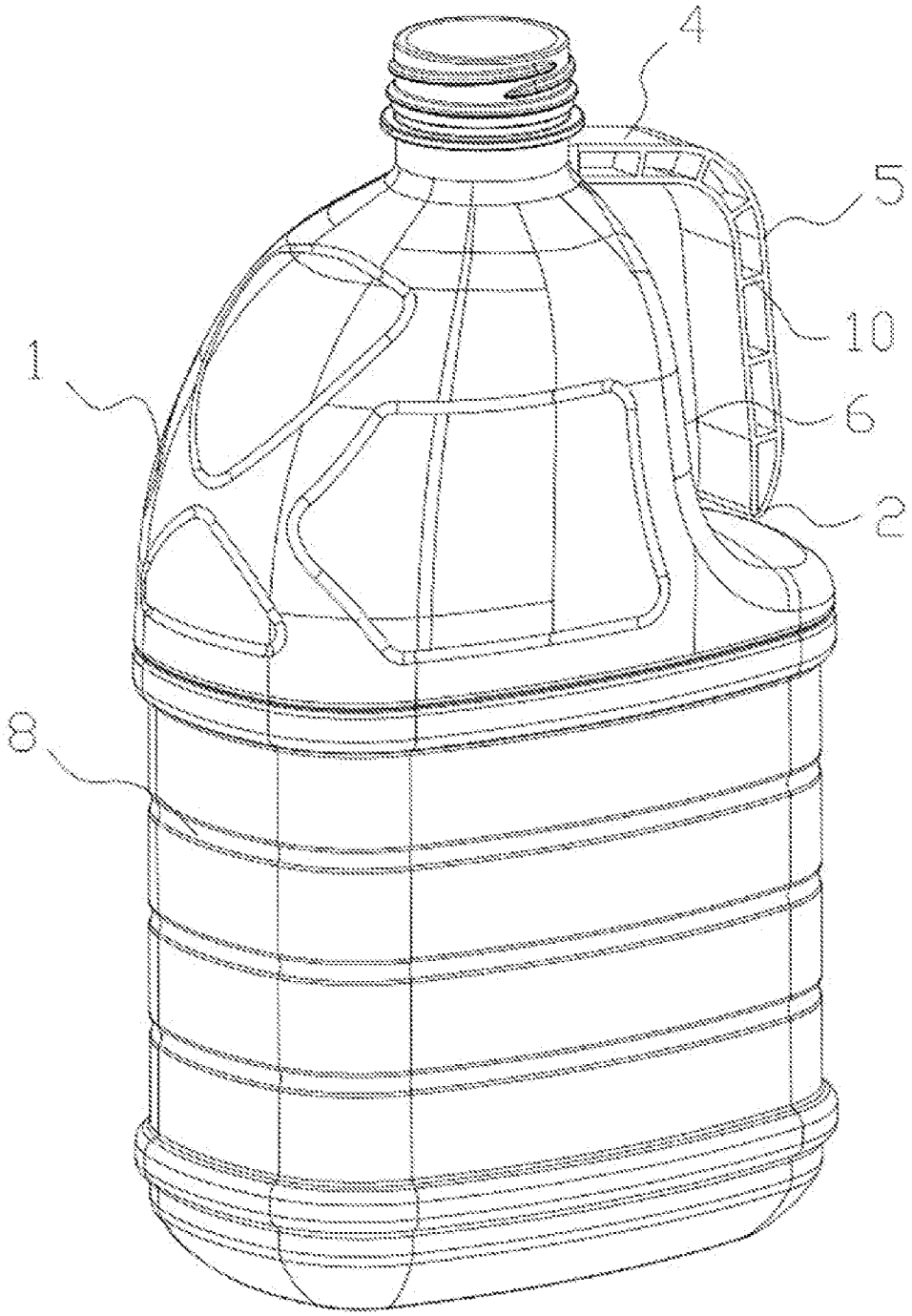

A container bottle, as shown in FIGS. 1 to 3, includes a bottle body 1 and a handle 2 disposed at a neck of the bottle body 1, where one end of the handle 2 is connected to the neck of the bottle body 1, and the other end of the handle 2 is in a free state.

As shown in FIG. 2, a reinforcing rib 3 is disposed between the lower surface of the handle 2 and the bottle body 1 so that the strength of the handle 2 is reinforced.

As shown in FIG. 3, the handle 2 has a double-layer structure, and multiple reinforcing plates 10 are spaced apart between layers. This structure of the handle 2 can reinforce the strength of the handle 2.

The included angle between a horizontal portion 4 and an inclined portion 5 of the handle 2 is in a range of 90° to 120°, for example, 90°, 91°, 92°, 93°, 94°, 95°, 96°, 97°, 98°, 99°, 100°, 101°, 102°, 103°, 104°, 105°, 106°, 107°, 108°, 109°, 110°, 111°, 112°, 113°, 114°, 115°, 116°, 117°, 118°, 119°, or 120°, which facilitates the holding or hanging of the handle.

The thickness of the handle 2 ranges from 6 mm to 15 mm, for example, 6 mm, 7 mm, 8 mm, 9 mm, 10 mm, 11 mm, 12 mm, 13 mm, 14 mm, or 15 mm, so that the strength of the handle 2 is reinforced.

A recessed surface 6 is disposed at a position of the bottle body 1 opposite to the handle 2 so as to avoid interference with the handle 2.

As shown in FIG. 2, reinforcing stiffeners 7 are spaced apart on the recessed surface 6 to reinforce the strength of the bottle body 1.

Multiple ring-shaped grooves 8 are spaced apart on the bottle body 1 from top to bottom, which not only enhances the aesthetic appearance of the bottle body 1 but also reduces the weight of the bottle body 1.

As shown in FIG. 2, multiple strip-shaped grooves 9 are spaced apart on each of an upper portion and a lower portion of the bottle body 1, which not only enhances the aesthetic appearance of the bottle body 1 but also reduces the weight of the bottle body 1.

What is claimed is:

1. A container bottle, comprising a bottle body and a handle disposed at a neck of the bottle body, wherein one end of the handle is connected to the neck of the bottle body, and another end of the handle is in a free state, wherein the handle has a double-layer structure, and a plurality of reinforcing plates are spaced apart between layers, an included angle between a horizontal portion and an inclined portion of the handle is in a range of 90° to 120°, a thickness of the handle ranges from 6 mm to 15 mm, a recessed surface is disposed at a position of the bottle body opposite to the handle, and reinforcing stiffeners are spaced apart on the recessed surface.

2. The container bottle according to claim 1, wherein a reinforcing rib is disposed between a lower surface of the handle and the bottle body.

3. The container bottle according to claim 1, wherein a plurality of ring-shaped grooves are spaced apart on the bottle body from top to bottom.

4. The container bottle according to claim 3, wherein a plurality of strip-shaped grooves are spaced apart on each of an upper portion and a lower portion of the bottle body.

* * * * *